US011326860B1

(12) United States Patent
Guo

(10) Patent No.: US 11,326,860 B1
(45) Date of Patent: May 10, 2022

(54) AMMUNITION ASSEMBLY

(71) Applicant: Xuyang Guo, Beijing (CN)

(72) Inventor: Xuyang Guo, Beijing (CN)

(73) Assignee: Xuyang Guo, Beijing (CN)

( * ) Notice: Subject to any disclaimer, the term of this patent is extended or adjusted under 35 U.S.C. 154(b) by 0 days.

(21) Appl. No.: 17/579,797

(22) Filed: Jan. 20, 2022

(51) Int. Cl.
*F42B 14/06* (2006.01)
*F42B 5/02* (2006.01)
*F42B 14/02* (2006.01)

(52) U.S. Cl.
CPC ..... *F42B 5/025* (2013.01); *F42B 14/02* (2013.01); *F42B 14/064* (2013.01)

(58) Field of Classification Search
CPC ..... F42B 14/064; F42B 14/061; F42B 12/16; F42B 14/06; F42B 14/02; F42B 14/067; F42B 14/068; F42B 14/062; F41A 21/12; F41A 21/10; F41A 21/46
USPC ..... 102/520–522; 89/14.6
See application file for complete search history.

(56) References Cited

U.S. PATENT DOCUMENTS 3,762,332 A * 10/1973 Witherspoon ..... F42B 14/064 102/523
4,040,331 A * 8/1977 Litman ..... F42B 12/34 102/515
5,164,539 A * 11/1992 French ..... F42B 14/064 102/520
5,452,535 A * 9/1995 See ..... F41A 21/40 89/14.6
6,814,006 B2 * 11/2004 Johansson ..... F42B 14/068 102/522
7,156,084 B1 * 1/2007 Landis ..... F41B 11/00 124/50
2003/0167958 A1 * 9/2003 Johansson ..... F42B 14/064 102/522

FOREIGN PATENT DOCUMENTS

WO WO-0175391 A1 * 10/2001 ..... F42B 14/064

* cited by examiner

*Primary Examiner* — Jonathan C Weber
(74) *Attorney, Agent, or Firm* — Nadya Reingand; Yan Hankin

(57) ABSTRACT

An ammunition assembly is provided, which includes a projectile and a fixture, where the projectile includes a penetrating, a sabot and a sabot holder, the sabot is sleeved on an outside of the penetrating, the sabot is of a split structure, the sabot holder is sleeved on an outside of the sabot, the sabot holder is located at one end of the sabot far away from the penetrating; the projectile is slidably provided in the chamber; the fixture includes clamping blocks, the clamping blocks are movably provided in the gun barrel, and the clamping blocks are capable of extending into the chamber and blocking the sabot holder.

10 Claims, 4 Drawing Sheets

AMMUNITION ASSEMBLY

TECHNICAL FIELD

The present disclosure relates to the technical field of ammunition weapons, in particular to an ammunition assembly or ammunition structure.

BACKGROUND ART

Ammunition is an ordnance item containing gunpowder, explosives or other fillings, which can damage the target objects or complete other tactical tasks after explosion. Ammunition includes bullets, cannonballs, grenades, rifle grenades, aerial bombs, rockets, missiles, torpedoes, deep-water bombs, torpedo, land mines, explosive cartridges, explosive packs, blasters and so on, as well as saluting guns, police bombs, hunting bombs and shooting sports bombs for non-military purposes.

Ammunition includes full caliber ammunition and sub-caliber ammunition. The structure of full caliber ammunition is different from that of sub-caliber ammunition, and the applicable firearm structure is also different therebetween. In practical application, it is necessary to replace the firearm structure while replacing ammunition with different calibers, which affects the working efficiency.

Therefore, how to change the current situation, in which the replacement of full caliber ammunition and sub-caliber ammunition is cumbersome and thus the working efficiency is reduced in the prior art, has become an urgent problem for those skilled in the art.

SUMMARY

The purpose of some embodiments is to provide an ammunition assembly or ammunition structure to solve the aforementioned problems existing in the prior art, so as to improve the flexibility and adaptability of the ammunition structure, and improve the working efficiency of the ammunition.

To achieve the above purpose, some embodiments provide the following solution. The present disclosure provides an ammunition structure, including:

a projectile, where the projectile includes a penetrating, a sabot and a sabot holder, the sabot is sleeved on an outside of the penetrating, the sabot is of a split structure, the sabot holder is sleeved on an outside of the sabot, the sabot holder is located at a first end of the sabot which is away from the penetrating, and the projectile is slidably provided in a chamber; and a fixture, where the fixture includes clamping blocks, the clamping blocks are movably provided in a gun barrel, and the clamping blocks are capable of extending into the chamber and clamping the sabot holder.

Preferably, the penetrating includes an penetrating core and a ballistic cap connected with the penetrating core, the penetrating core is cylindrical, the ballistic cap is conical, and a bottom portion of the ballistic cap is connected with the penetrating core.

Preferably, the sabot includes two sabots arranged oppositely, the two sabots are provided with two spaces for penetrator respectively, and the two spaces for penetrator are enclosed to form a cylindrical groove capable of accommodating the penetrating core.

Preferably, the projectile further includes a rotating band, the rotating band is sleeved on the outside of the sabot, and the rotating band is capable of maintaining relative position of the two sabots.

Preferably, the sabot includes an installation groove matched with the rotating band, the rotating band is located in the installation groove, and the installation groove is located at a second end of the sabot which is away from the sabot holder.

Preferably, for each of the clamping blocks, a first end of the clamping block is hinged with the gun barrel, a second end of the clamping block is capable of extending into the chamber and abutting against the sabot, an elastic member is provided between the clamping block and the gun barrel, the elastic member is configured to enable the clamping block abut against the sabot, and a position that the clamping block is abutted against the sabot is between the sabot holder and the penetrating.

Preferably, limiting blocks are further provided in the gun barrel, each of the clamping blocks are provided with a positioning block, the positioning block is configured to be clamped with a corresponding one of the limiting blocks, when the positioning block is clamped with the corresponding one of the limiting blocks, the clamping blocks are separated from the sabot and retracted into the gun barrel.

Preferably, a surface of each of the clamping blocks which abuts against the sabot is a curved surface.

Preferably, the clamping blocks include two clamping blocks, and the two clamping blocks are symmetrically provided with respect to an axis of the gun barrel.

Preferably, the sabot holder is of a rotation body structure, and the sabot holder is provided with a through hole capable of accommodating the sabot.

Compared with the prior art, the technical effects of the ammunition structure disclosed by some embodiments are as follows. The ammunition structure includes a projectile and a fixture. The projectile includes a penetrating, a sabot and a sabot holder. The sabot is sleeved on an outside of the penetrating. The sabot is of a split structure. The sabot holder is sleeved on an outside of the sabot. The sabot holder is provided at one end of the sabot which is away from the penetrating. The projectile is slidably provided in the chamber. The fixture includes clamping blocks. The clamping blocks are movably provided in the gun barrel, and the clamping blocks are capable of extending into the chamber and clamping the sabot holder.

The ammunition structure of the present disclosure includes a projectile and a fixture. When the clamping blocks extend into the chamber and clamps the sabot holder, the clamping blocks are capable of preventing the sabot holder from being launched together with the remaining portions of the projectile pushed by propellant gas. The inner rifling in the chamber causes the centripetal force generated by the spin of the trajectile and the air resistance to separate outwards the split sabot, and the trajectile is a sub-caliber shelling armor-piercing munition. When the clamping blocks retract into the gun barrel, the sabot holder is not blocked by the clamping blocks, and the sabot holder is fixed on the sabot by the friction force, so that there is no relative movement between the sabot and the sabot holder. When the sabot holder is pushed by propellant gas, the sabot holder acts as a trajectile together with the remaining portions of the projectile. That the centripetal force makes the sabot tend to separate towards the spin tangential is inhibited by the enclosing and fixing of the sabot holder. At this time, the trajectile is ejected as a full caliber warhead. It should also be noted that, by adopting warhead bodies with different structures, the replacement between grape-shot and single-shot ammunition is realized, thereby further improving the adaptability of the ammunition structure and the working efficiency of the ammunition.

BRIEF DESCRIPTION OF THE DRAWINGS

In order to more clearly illustrate technical solutions in the embodiments of the present application or in the prior art, a brief introduction to the accompanying drawings required for the embodiment will be provided below. Obviously, the accompanying drawings in the following description are only some of the embodiments of the present disclosure. Those of ordinary skill in the art would also be able to derive other drawings from these drawings without making creative efforts.

In the figures, 100 ammunition structure; 1 projectile; 2 fixture; 3 penetrating; 4 sabot; 5 sabot holder; 6 clamping block; 7 penetrating core; 8 ballistic cap; 9 sabot; 10 space for penetrator; 11 rotating band; 12 installation groove; 13 limiting block; 14 positioning block; 15 elastic member; 16 chamber; 17 gun barrel.

DETAILED DESCRIPTION OF THE EMBODIMENTS

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments of the present invention, all other embodiments obtained by those of ordinary skill in the art without creative work shall fall within the protection scope of the present invention.

The purpose of some embodiments is to provide an ammunition assembly or ammunition structure to solve the aforementioned problems existing in the prior art, so as to improve the flexibility and adaptability of the ammunition structure, and improve the working efficiency of the ammunition.

In order to make the objectives, features, and advantages mentioned above of the present disclosure more apparent and easily understood, the present disclosure will be further described in detail below with reference to the drawings and particular implementations.

Figure 1:
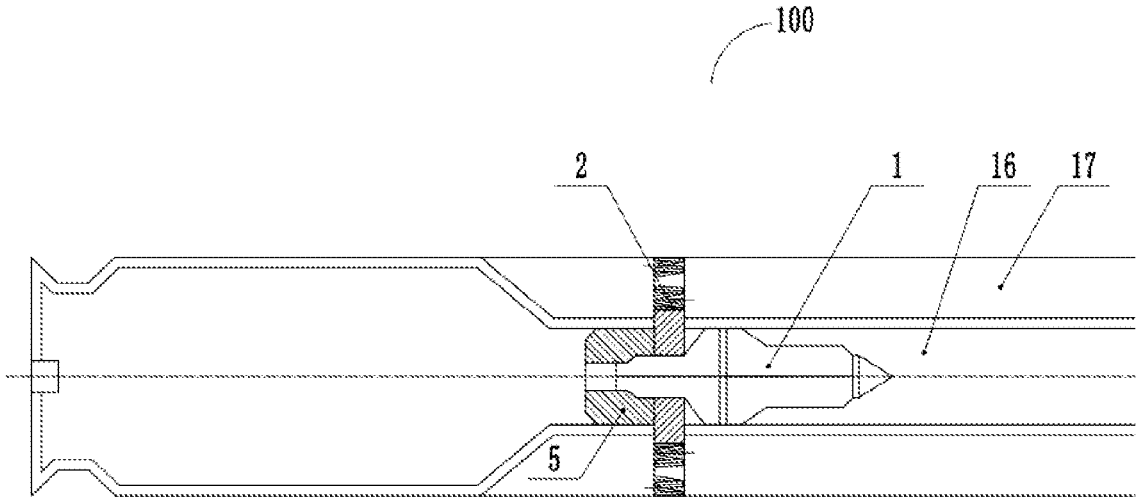
FIG. 1 is a structural schematic diagram of an ammunition structure according to the present disclosure.
Figure 2:
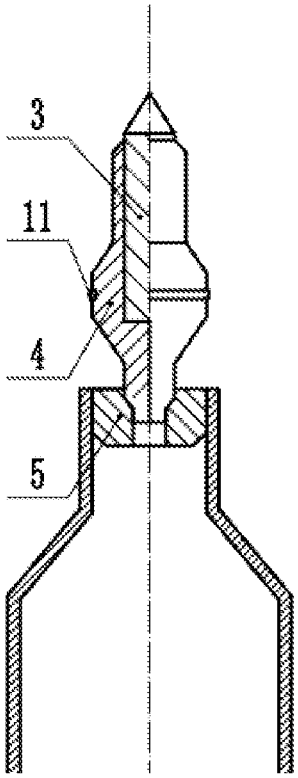
FIG. 2 is a structural schematic diagram of a projectile of an ammunition structure according to the present disclosure.
Figure 3:
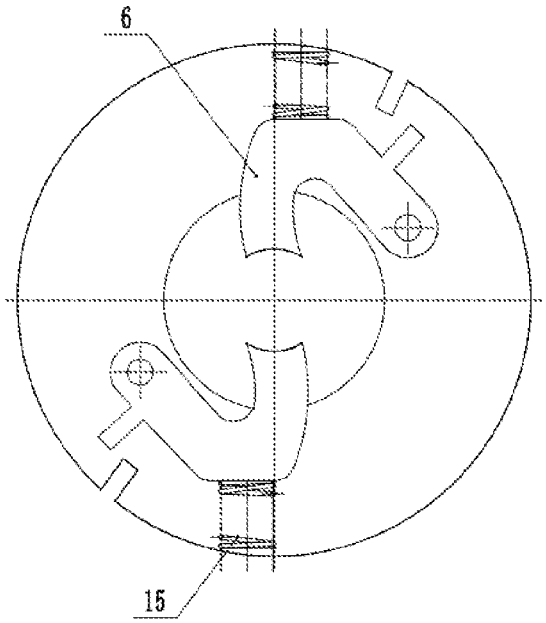
FIG. 3 is a structural schematic diagram of a fixture of an ammunition structure according to the present disclosure.
Figure 4:
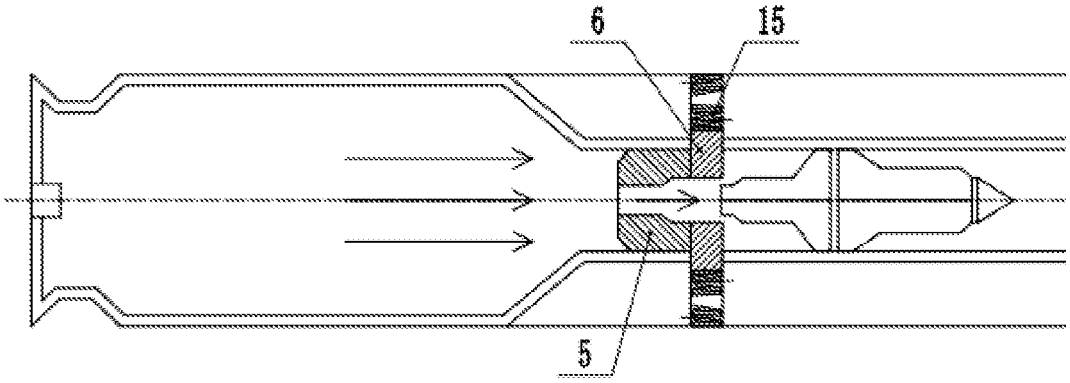
FIG. 4 is a first working schematic diagram of an ammunition structure according to the present disclosure.
Figure 5:
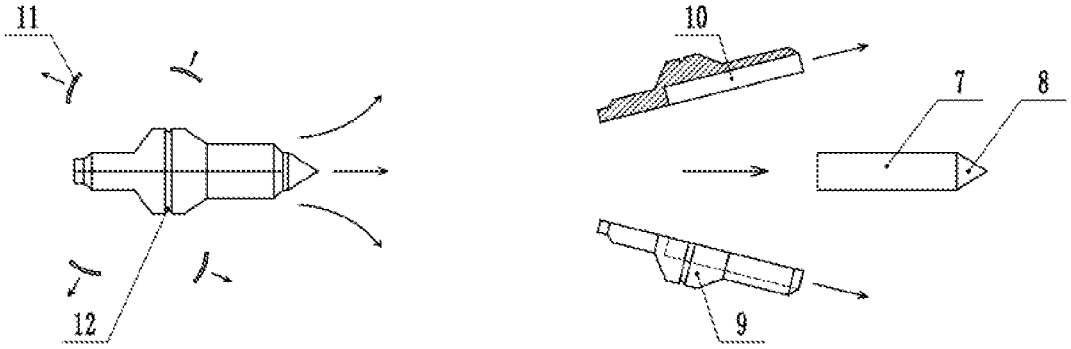
FIG. 5 is a second working schematic diagram of an ammunition structure according to the present disclosure.
Figure 6:
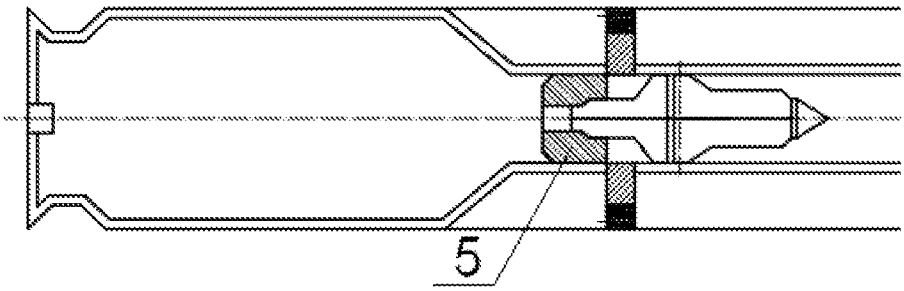
FIG. 6 is a schematic diagram of an ammunition structure according to an embodiment of the present disclosure.
Figure 7:
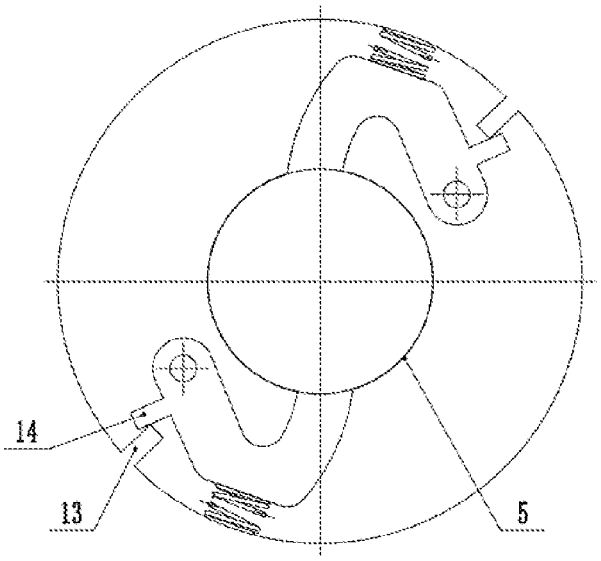
FIG. 7 is a structural diagram of a fixture of an ammunition structure according to an embodiment of the present disclosure.
Figure 8:
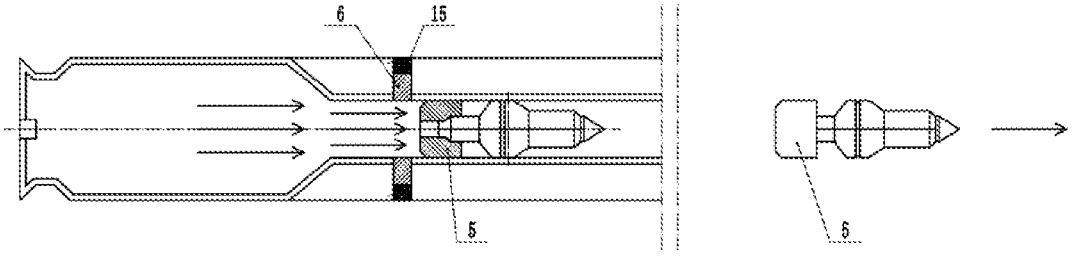
FIG. 8 is a third working schematic diagram of an ammunition structure according to the present disclosure.

Referring to FIGS. 1-8, FIG. 1 is a structural schematic diagram of an ammunition structure according to the present disclosure, FIG. 2 is a structural schematic diagram of a projectile of an ammunition structure according to the present disclosure, FIG. 3 is a structural schematic diagram of a fixture of an ammunition structure according to the present disclosure, FIG. 4 is a first working schematic diagram of an ammunition structure according to the present disclosure, FIG. 5 is a second working schematic diagram of an ammunition structure according to the present disclosure, FIG. 6 is a schematic diagram of an ammunition structure according to an embodiment of the present disclosure, FIG. 7 is a structural diagram of a fixture of an ammunition structure according to an embodiment of the present disclosure, and FIG. 8 is a third working schematic diagram of an ammunition structure according to the present disclosure.

The present disclosure provides an ammunition structure 100, which includes a projectile 1 and a fixture 2, the projectile 1 includes a penetrating 3, a sabot 4 and a sabot holder 5, the sabot 4 is sleeved on an outside of the penetrating 3, the sabot 4 is of a split structure, the sabot holder 5 is sleeved outside the sabot 4, the sabot holder 5 is located at a first end of the sabot 4 which is far away from the penetrating 3, and the projectile 1 is slidably provided in a chamber 16; the fixture 2 includes clamping block 6, the clamping block 6 are movably provided in the gun barrel 17, and the clamping blocks 6 are capable of extending into the chamber 16 and blocking the sabot holder 5.

The ammunition structure 100 of the present disclosure includes a projectile 1 and a fixture 2. When the clamping blocks 6 extend into the chamber 16 and clamps the sabot holder 5, the clamping blocks 6 are capable of preventing the sabot holder 5 from being launched together with the remaining portions of the projectile 1 pushed by propellant gas. The inner rifling in the chamber 16 causes the centripetal force generated by the spin of the trajectile and the air resistance to separate outwards the split sabot 4, and the trajectile is a sub-caliber shelling armor-piercing munition. When the clamping blocks 6 retract into the gun barrel 17, the sabot holder 5 is not blocked by the clamping blocks 6, and the sabot holder 5 is fixed on the sabot 4 by the friction force, so that there is no relative movement between the sabot 4 and the sabot holder 5. When the sabot holder 5 is pushed by propellant gas, the sabot holder acts as a trajectile together with the remaining portions of the projectile 1. That the centripetal force which makes the sabot 4 tend to separate towards the spin tangential is inhibited by the enclosing and fixing of the sabot holder 5. At this time, the trajectile is ejected as a full caliber warhead. It should also be noted that, by adopting warhead bodies 3 with different structures, the replacement between grape-shot and single-shot ammunition is realized, thereby further improving the adaptability of the ammunition structure 100 and the working efficiency of the ammunition.

In this specific embodiment, taking the single-shot ammunition as an example, the penetrating 3 includes an penetrating core 7 and a ballistic cap 8 connected with the penetrating core 7. The penetrating core 7 is cylindrical, and the penetrating core 7 may be made of materials with high density and high hardness, such as tungsten alloy. The ballistic cap 8 is conical, and the bottom portion of the ballistic cap 8 is connected with the penetrating core 7. The ballistic cap 8 is provided as a cone, which can reduce the resistance of flight. When selecting the material of the ballistic cap 8, it is possible to select a material which is easy to deform or break and has low cost, such as rubber or aluminum, while maintaining enough to bear the wind resistance. The ballistic cap 8 may be provided as a hollow structure.

Specifically, the sabot 4 includes two sabots 9 arranged oppositely, the two sabots 9 are provided with two spaces for penetrator 10 respectively, and the two spaces for penetrator 10 are enclosed to form a cylindrical groove capable of accommodating the penetrating core 7. The sabot 4 is a split structure, thus it is advantageous for the trajectile to be a sub-caliber shelling armor-piercing munition.

In addition, the projectile 1 further includes a rotating band 11, the rotating band 11 is sleeved on an outside of the sabot 4, and the rotating band 11 is capable of fixing the relative position of the two sabots 9 for fitting the rifling to ensure the gas tightness. When the projectile 1 is launched, the rotating band 11 is worn down, and the intensity of the rotating band 11 is reduced. In the case where the trajectile is a sub-caliber shelling armor-piercing munition, the rotating band 11 will be cut off by the sabot 4 when the sabot 4 is separated outwards. The rotating band 11 is annular, and may be made of copper as the rotating band 11 needs certain ductility.

In this specific embodiment, the sabot 4 has an installation groove 12 matched with the rotating band 11, the rotating band 11 is located in the installation groove 12. The installation groove 12 is located in the middle of the trajectile holder 4. The installation groove 12 provides a space for installing the rotating band 11 and limits the position of the rotating band 11.

More specifically, for each of the clamping blocks 6, one end of the clamping block 6 is hinged with the gun barrel 17, and the other end of the clamping block 6 is capable of extending into the chamber 16 and abutting against the sabot 4. An elastic member 15 is provided between the clamping block 6 and the gun barrel 17. The elastic member 15 is configured to enable the clamping block 6 abut against the sabot 4. A position that the clamping block 6 is abutted against the sabot 4 is between the sabot holder 5 and the penetrating 3. In this specific embodiment, the clamping block 6 is V-shaped. One end of the clamping block 6 is hinged with the gun barrel 17. Under the action of the elastic member 15, the other end of the clamping block 6 extends into the chamber 16 and abuts against the sabot 4. More importantly, the clamping block 6 abuts against the end face of the sabot holder 5, which clamps the sabot holder 5 and prevents the sabot holder 5 from being launched together with the remaining portions of the projectile 1.

Further, a limiting block 13 is further provided in the gun barrel 17. The clamping block 6 is provided with a positioning block 14 matched with the limiting block 13. The positioning block 14 is configured to be clamped with the limiting block 13. When the clamping block 6 is rotated, the positioning block 14 is snapped or coupled with the limiting block 13, and the other end of the clamping block 6 is separated from the sabot 4 and retracted into the gun barrel 17, so that the sabot holder 5 can be launched smoothly together with the projectile 1 without being blocked.

In this specific embodiment, the surface of the clamping block 6 which abuts against the sabot 4 is a curved surface, so as to increase the contact area between the clamping block 6 and the sabot 4, which ensures that the clamping block 6 is capable of blocking the sabot holder 5.

In order to enhance the blocking effect of the clamping blocks 6 on the sabot holder 5, the number of the clamping blocks 6 is set to two, and the two clamping blocks 6 are symmetrically provided with respect to the axis of the gun barrel 17. The clamping blocks 6 are symmetrically arranged, which improves the uniformity of the bearing force of the sabot 4.

Furthermore, it should be noted that the sabot holder 5 is a rotation body structure, which improves the uniformity of the bearing force of the sabot holder 5. The sabot holder 5 is provided with a through hole capable of accommodating the sabot 4, thereby ensuring that propellant gas can exert the acting force on the sabot 4 and the penetrating 3, which ensures the smooth launch of the projectile 1.

The ammunition structure 100 of the present disclosure is provided, when the clamping blocks 6 extend into the chamber 16 and clamps the sabot holder 5, the clamping blocks 6 are capable of preventing the sabot holder 5 from being launched together with the remaining portions of the projectile 1 pushed by propellant gas. The inner rifling in the chamber 16 causes the centripetal force generated by the spin of the trajectile and the air resistance to separate outwards the split sabot 4. A part of the sabot 4 breaks off the rotating band 11, as the rotating band 11 is cut and worn by the rifling and due to the centripetal force thereof, the structural strength of the rotating band 11 is reduced, the projection part is a sub-caliber shelling armor-piercing munition. When the clamping blocks 6 retract into the gun barrel 17, the sabot holder 5 is not blocked by the clamping blocks 6, and the sabot holder 5 is fixed on the sabot 4 by the friction force, so that there is no relative movement between the sabot 4 and the sabot holder 5. When the sabot holder 5 is pushed by propellant gas, the sabot holder 5 acts as a trajectile together with the remaining portions of the projectile 1. That the centripetal force which makes the sabot 4 tend to separate towards the spin tangential is inhibited by the enclosing and fixing of the sabot holder 5. At this time, the trajectile is ejected as a full caliber warhead. It should also be noted that, by adopting warhead bodies 3 with different structures, the replacement between grape-shot and single-shot ammunition is realized.

Specific embodiments are used in this specification for illustration of the principles and implementations of the present disclosure. The description of the above embodiments is merely used to help understand the method and core concept of the present disclosure. In addition, those of ordinary skill in the art may make modifications to the specific implementations and application scope in accordance with the concept of the present disclosure. In conclusion, the content of this specification should not be construed as a limitation to the present disclosure.

What is claimed is:

1. An ammunition assembly, comprising:

a projectile, wherein the projectile comprises a penetrating, a sabot and a sabot holder, the sabot is sleeved on an outside of the penetrating, the sabot is of a split structure, the sabot holder is sleeved on an outside of the sabot, the sabot holder is located at a first end of the sabot which is away from the penetrating, and the projectile is slidably provided in a chamber; and a fixture, wherein the fixture comprises clamping blocks, the clamping blocks are movably provided in a gun barrel, and the clamping blocks are capable of extending into the chamber and clamping the sabot holder.

2. The ammunition assembly according to claim 1, wherein the penetrating comprises an penetrating core and a ballistic cap connected with the penetrating core, the penetrating core is cylindrical, the ballistic cap is conical, and a bottom portion of the ballistic cap is connected with the penetrating core.

3. The ammunition assembly according to claim 2, wherein the sabot comprises two sabots arranged oppositely, the two sabots are provided with two spaces for penetrator respectively, and the two spaces for penetrator are enclosed to form a cylindrical groove capable of accommodating the penetrating core.

4. The ammunition assembly according to claim 3, wherein the projectile further comprises a rotating band, the rotating band is sleeved on the outside of the sabot, and the rotating band is capable of maintaining relative position of the two sabots.

5. The ammunition assembly according to claim 4, wherein the sabot comprises an installation groove matched with the rotating band, the rotating band is located in the installation groove, and the installation groove is located at a second end of the sabot which is away from the sabot holder.

6. The ammunition assembly according to claim 1, wherein for each of the clamping blocks, a first end of the clamping block is hinged with the gun barrel, a second end of the clamping block is capable of extending into the chamber and abutting against the sabot, an elastic member is provided between the clamping block and the gun barrel, the elastic member is configured to enable the clamping block abut against the sabot, and a position that the clamping block is abutted against the sabot is between the sabot holder and the penetrating.

7. The ammunition assembly according to claim 6, wherein limiting blocks are further provided in the gun barrel, each of the clamping blocks are provided with a positioning block, the positioning block is configured to be clamped with a corresponding one of the limiting blocks, when the positioning block is clamped with the corresponding one of the limiting blocks, the clamping blocks are separated from the sabot and retracted into the gun barrel.

8. The ammunition assembly according to claim 1, wherein a surface of each of the clamping blocks which abuts against the sabot is a curved surface.

9. The ammunition assembly according to claim 1, wherein the clamping blocks comprise two clamping blocks, and the two clamping blocks are symmetrically provided with respect to an axis of the gun barrel.

10. The ammunition assembly according to claim 1, wherein: the sabot holder is of a rotation body structure, and the sabot holder is provided with a through hole capable of accommodating the sabot.

* * * * *